US005417381A

United States Patent [19]

Inoue et al.

[11] Patent Number: 5,417,381

[45] Date of Patent: May 23, 1995

[54] HOLDER FOR NON-ADHESIVE TAPE

[75] Inventors: Nori Inoue; Hisakazu Ito, both of Yokkaichi, Japan

[73] Assignee: Sumitomo Wiring Systems, Ltd., Japan

[21] Appl. No.: 204,781

[22] Filed: Mar. 2, 1994

[30] Foreign Application Priority Data

Mar. 4, 1993 [JP] Japan ..... 5-015199 U

[51] Int. Cl.[6] ..... B65H 23/08; B65H 16/04

[52] U.S. Cl. ..... 242/396.6; 242/597.1; 242/597.5

[58] Field of Search ..... 242/396.6, 597, 597.1, 242/597.5

[56] References Cited

U.S. PATENT DOCUMENTS

| | | | |
|---|---|---|---|
| 3,531,057 | 9/1970 | Way | 242/597.5 |
| 4,114,826 | 9/1978 | Diebolder | 242/597.5 |
| 5,094,395 | 3/1992 | Lambert | 242/597 |

FOREIGN PATENT DOCUMENTS

| | | |
|---|---|---|
| 1058434 | 3/1954 | France . |
| 1572545 | 3/1969 | France . |
| 27700 | 10/1961 | Japan . |

*Primary Examiner*—Daniel P. Stodola
*Assistant Examiner*—William A. Rivera
*Attorney, Agent, or Firm*—Jordan B. Bierman; Bierman and Muserlian

[57] ABSTRACT

A non-adhesive tape holder (20) which comprises a drum body (21), a tape restraining member (22), a coil spring (23), and a rotation-preventing projection (30). The tape restraining member (22) is bent into a generally inclined U shape and includes a support shaft portion (32), a connecting portion (33), and a tape hold-down portion (34). The support shaft portion (32) is supported by the drum body (21) rotatably about an axis parallel to the axis of the drum body (21) in a position eccentric relative to the axis of the drum body (21). The coil spring (23) is housed in a spring-receiving recess (27) of the drum body (21) and elastically urges the tape restraining member (22) to rotate the tape restraining member (22) about the axis of the support shaft portion (32). The connecting portion (33) of the tape restraining member (22) rotated by the urging force of the coil spring (23) abuts against the rotation-preventing projection (30) movably toward and away from the rotation-preventing projection (30). The non-adhesive tape holder (20) provides increased operating efficiency during tape winding.

5 Claims, 6 Drawing Sheets

HOLDER FOR NON-ADHESIVE TAPE

BACKGROUND OF THE INVENTION

1. Field of the Invention

The present invention relates to a non-adhesive tape holder suitable for holding and winding a non-adhesive tape such as a vinyl tape.

2. Description of the Prior Art

Wound tapes are of two types: adhesive tapes and non-adhesive tapes. In general, adhesive tapes are often used from the standpoint of operating efficiency.

In consideration for recycle of automotive parts or the like, it is however difficult to disassemble harnesses around which the adhesive tape is wound. Further, the adhesive tape itself is not suitable as a recyclable material because it includes adhesives applied thereon.

Applications of the non-adhesive tape are expected to increase as the rate of recycling automotive parts increases in future. A non-adhesive tape holder for more efficient storage of this type of non-adhesive tape and more efficient operation in tape winding is disclosed in Japanese Utility Model Publication No. 36-27700.

Referring to FIGS. 5 and 6, the disclosed non-adhesive tape holder 1 comprises: a case 5 including a drum body 3 to be inserted into a central hole 2*a* of a non-adhesive tape 2 from one side thereof and a hollow cylindrical portion 4 extending perpendicularly to the axis of the drum body 3; a tape restraining member 9 including a leg portion 7 within the case 5 having a projection 6 provided adjacent its lower end and fitted in a groove 4*a* of the hollow cylindrical portion 4, the leg portion 7 being vertically movable, and a tape hold-down portion 8 external to the case 5 and extending perpendicularly to the leg portion 7; and a coil spring 10 fitted between the inner wall of the case 5 and the projection 6 of the leg portion 7.

For holding the non-adhesive tape 2, the tape restraining member 9 is extracted against the elastic force of the coil spring 10 outwardly to an amount larger than the outer diameter of the non-adhesive tape 2. In this state, the drum body 3 of the case 5 is inserted into the central hole 2*a* of the non-adhesive tape 2. When the tape restraining member 9 is released, the elastic force of the coil spring 10 forces the tape hold-down portion 8 of the tape restraining member 9 against the non-adhesive tape 2 from outside. The non-adhesive tape 2 is held without coming unwound.

In the construction of the conventional non-adhesive tape holder 1, however, the tape restraining member 9 is extracted to the amount larger than the outer diameter of the non-adhesive tape 2, and the non-adhesive tape 2 is held by the elastic force of the coil spring 10. This necessitates a relatively great length of the hollow cylindrical portion 4.

The hollow cylindrical portion 4 projecting greatly beyond the outer peripheral surface of the non-adhesive tape 2 contacts or hitches on other jigs or products during tape winding to be a hindrance, resulting in the problem of operating efficiency left unsolved.

SUMMARY OF THE INVENTION

The present invention is intended for a non-adhesive tape holder for holding a non-adhesive wound tape. According to the present invention, the non-adhesive tape holder comprises: a drum body having a recess and received in a central hole of the wound tape, a tape restraining member rotatably supported by the drum body, an urging element for elastically urging the tape restraining member so as to rotate the tape restraining member, a rotation-preventing projection for regulating the rotation of the tape-restraining member, the tape restraining member being of a generally inclined U shape and including a support shaft portion supported by the drum body rotatably about an axis parallel to the axis of the drum body in a position eccentric relative to the axis of the drum body, a connecting portion extending perpendicularly to the axis of the support shaft portion from one end of the support shaft portion, and a tape hold-down portion extending perpendicularly to the axis of the connecting portion from an extending end of the connecting portion, the urging element being housed in the recess of the drum body for engaging the support shaft portion to elastically urge the tape restraining member for rotation of the tape restraining member about the axis of the support shaft portion, the rotation-preventing projection being provided on one end surface of the drum body so that the connecting portion of the tape restraining member rotated by the urging force of the urging element abuts against the rotation-preventing projection movably toward and away from the rotation-preventing projection.

According to the present invention, for holding the non-adhesive tape, the tape restraining member is rotated about the axis of the support shaft portion against the urging force of the urging element, and the drum body is inserted into the central hole of the non-adhesive tape, with the space between the tape hold-down portion and the outer peripheral surface of the drum body growing wider. When the tape restraining member is released, the urging force stored in the urging element returns the tape restraining member in the reverse direction about the axis of the support shaft portion, and the space between the tape hold-down portion and the outer peripheral surface of the drum body becomes shorter. The non-adhesive tape is pressed from outside by the tape hold-down portion. The non-adhesive tape is thus held without coming unwound.

The drum body supports the support shaft portion of the tape restraining member of generally inclined U shape, and the tape hold-down portion is moved toward and away from the outer peripheral surface of the drum body by the rotation of the support shaft portion about the axis thereof. The non-adhesive tape holder does not project so much from the outer peripheral surface of the non-adhesive tape.

The tape hold-down portion is designed to gradually approach the outer peripheral surface of the drum body as the outer diameter of the non-adhesive tape gradually becomes smaller while the non-adhesive tape is used. The non-adhesive tape holder does not project so much from the outer peripheral surface of the non-adhesive tape at all times and is effectively prevented from contacting or hitching on other jigs or products during tape winding. The operating efficiency is remarkably increased during tape winding.

An object of the present invention is to provide a non-adhesive tape holder which provides increased operating efficiency during tape winding.

These and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
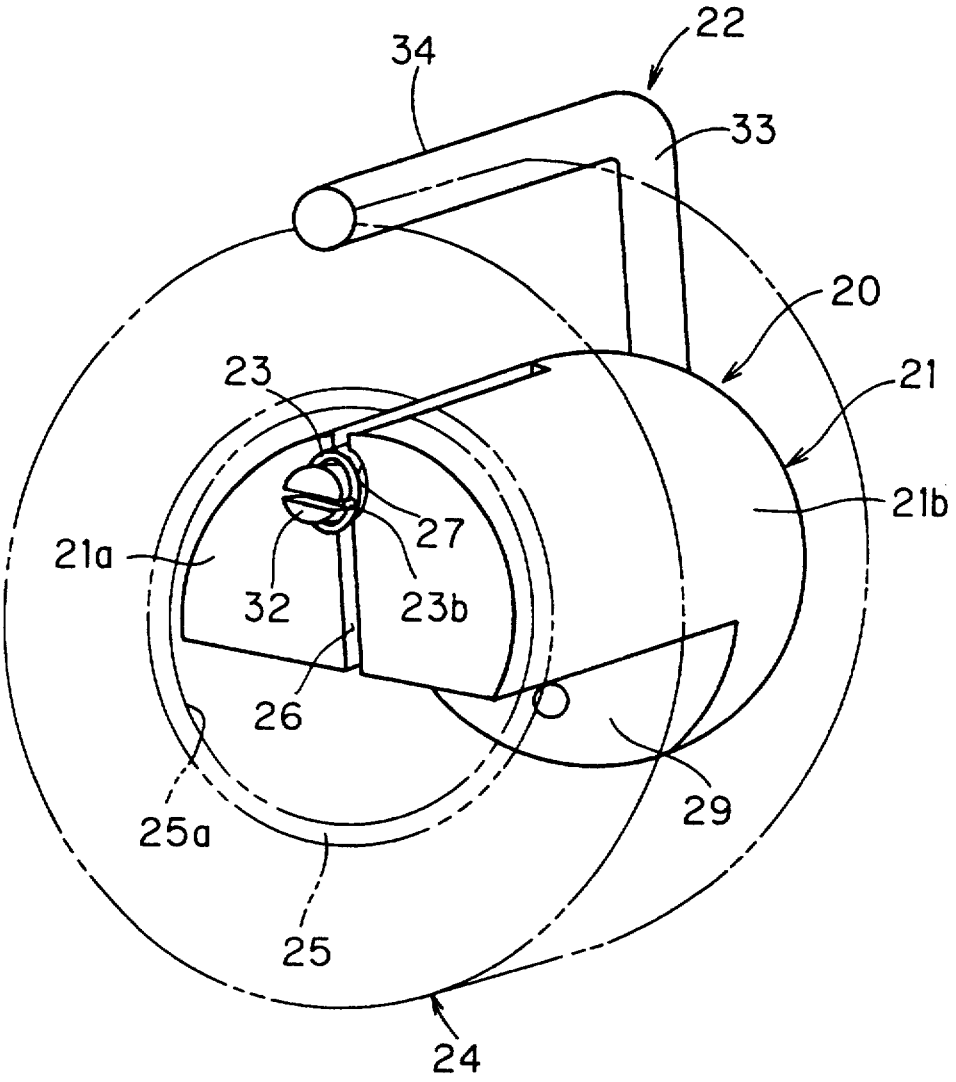
FIG. 1 is a perspective view of a preferred embodiment in use according to the present invention.
Figure 2:
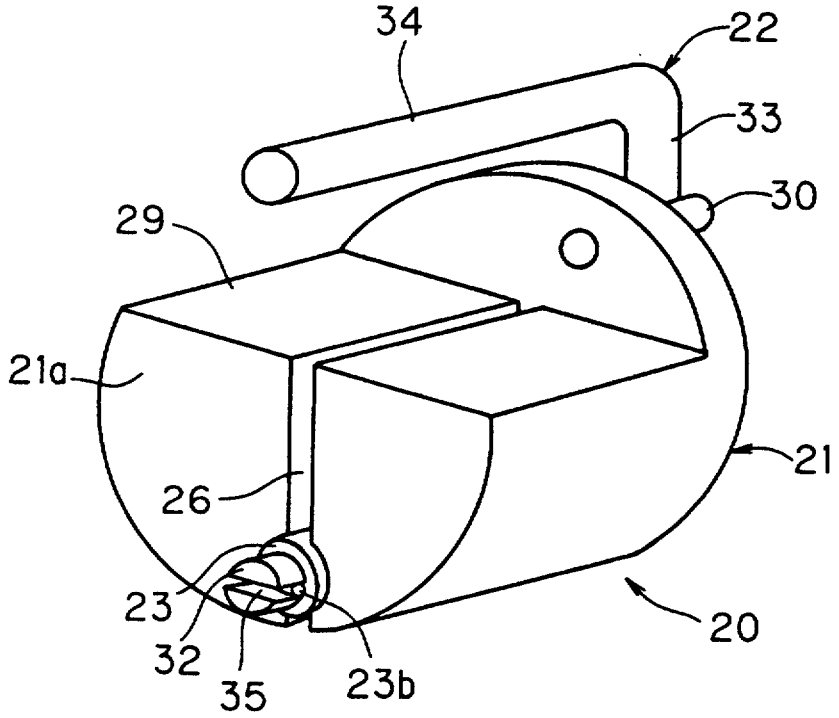
FIG. 2 is a perspective view of the preferred embodiment according to the present invention.
Figure 3:
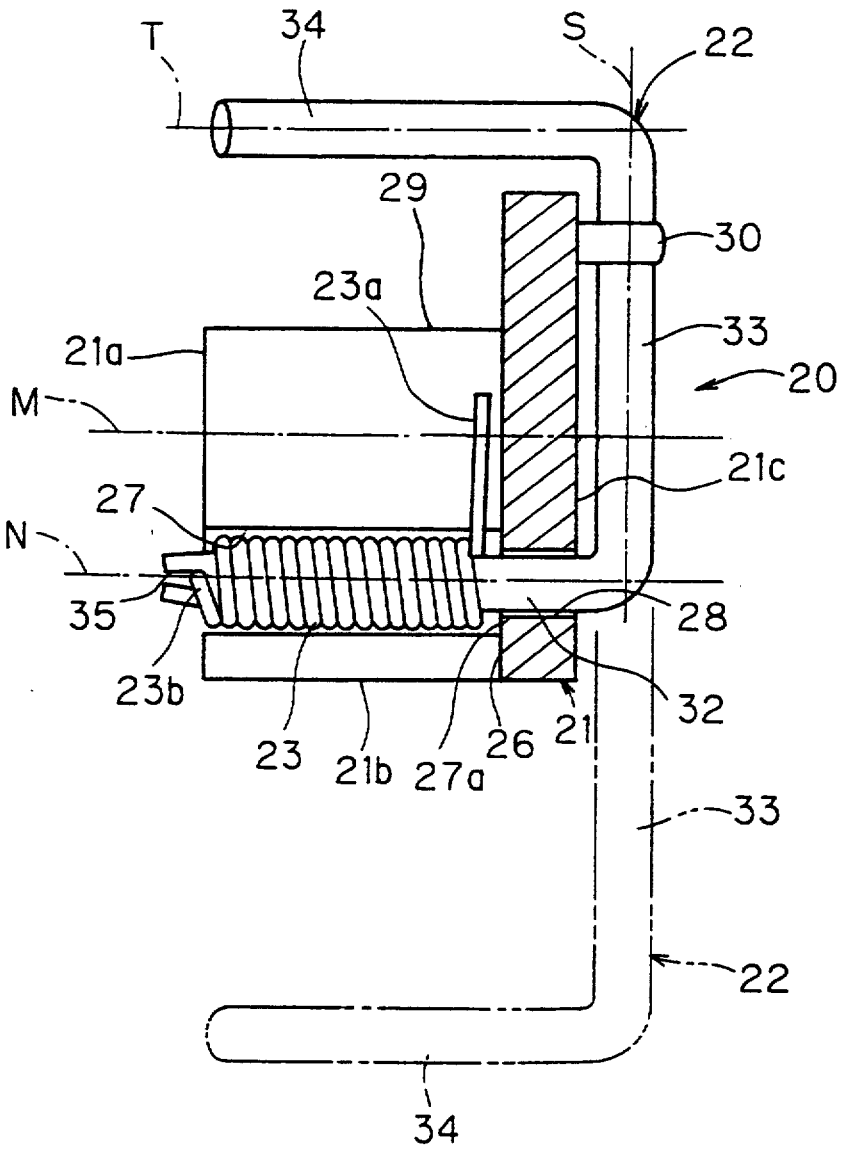
FIG. 3 is a sectional side elevation of the preferred embodiment according to the present invention.

Referring to the drawings, a preferred embodiment will now be described according to the present invention. In FIGS. 1 to 4, the reference numeral 20 designates a non-adhesive tape holder which comprises a drum body 21, a tape restraining member 22, and a coil spring 23 serving as an urging element.

The drum body 21 is a substantially cylindrical block of metal, resin or the like having an outer diameter permitted to be inserted into a central hole 25*a* of a core 25 around which a wound tape or a non-adhesive tape, e.g. a vinyl tape 24, is wound. The drum body 21 is formed with a radial slot 26 extending from a first side surface 21*a* into proximity with the other end thereof in its axial direction M.

A spring-receiving recess 27 extending in parallel with the axis M is formed from the first side surface 21*a* in a position of the slot 26 adjacent an outer peripheral surface 21*b* which is eccentric toward one side relative to the axis M of the drum body 21. A shaft-receiving hole 28 is formed which permits a bottom 27*a* of the spring-receiving recess 27 to communicate with a second side surface 21*c* of the drum body 21 in parallel with the axis M.

The outer peripheral portion of the drum body 21 eccentric toward the other side relative to the axis M is notched from the first side surface 21*a* to form a finger-receiving recess 29. A rotation-preventing projection 30 is formed by press fit and projects in parallel with the axis M on the second side surface 21*c* of the drum body 21 in a position corresponding to the finger-receiving recess 29.

The tape restraining member 22 is a metal rod bent into a generally inclined U shape and includes a support shaft portion 32 supported fittedly in the shaft-receiving hole 28 and spring-receiving recess 27 of the drum body 21, a connecting portion 33 extending perpendicularly to an axis N of the support shaft portion 32 from one end of the support shaft portion 32 adjacent to the second side surface 21*c*, and a tape hold-down portion 34 extending perpendicularly to an axis S of the connecting portion 33 from an extending end of the connecting portion 33.

Figure 4:
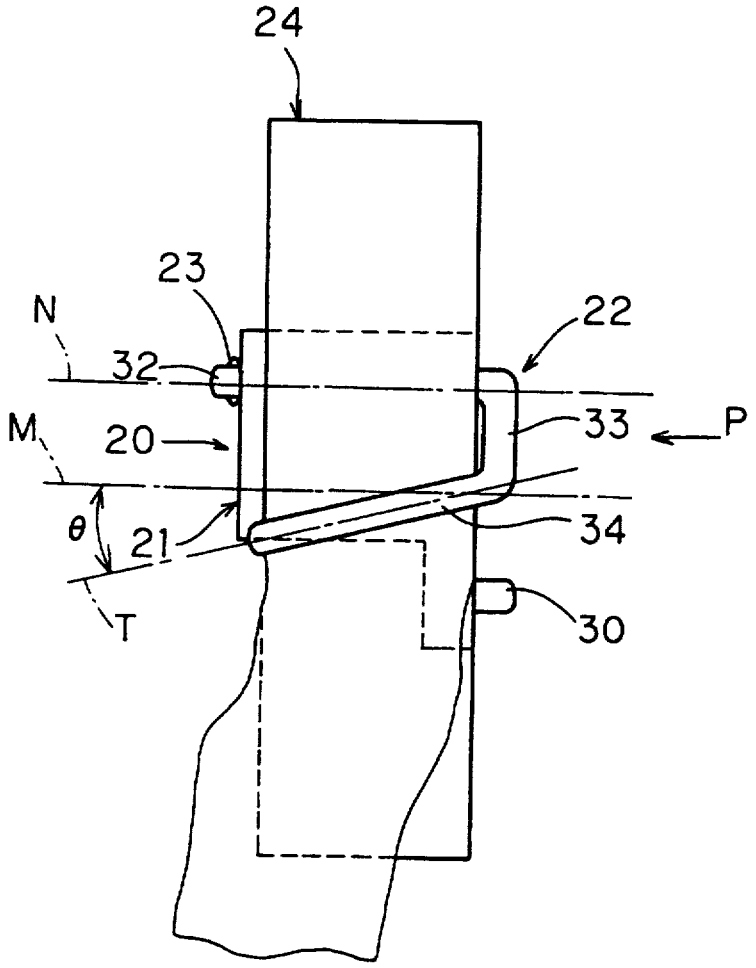
FIG. 4 is a plan view of the preferred embodiment in use according to the present invention.
Figure 5:
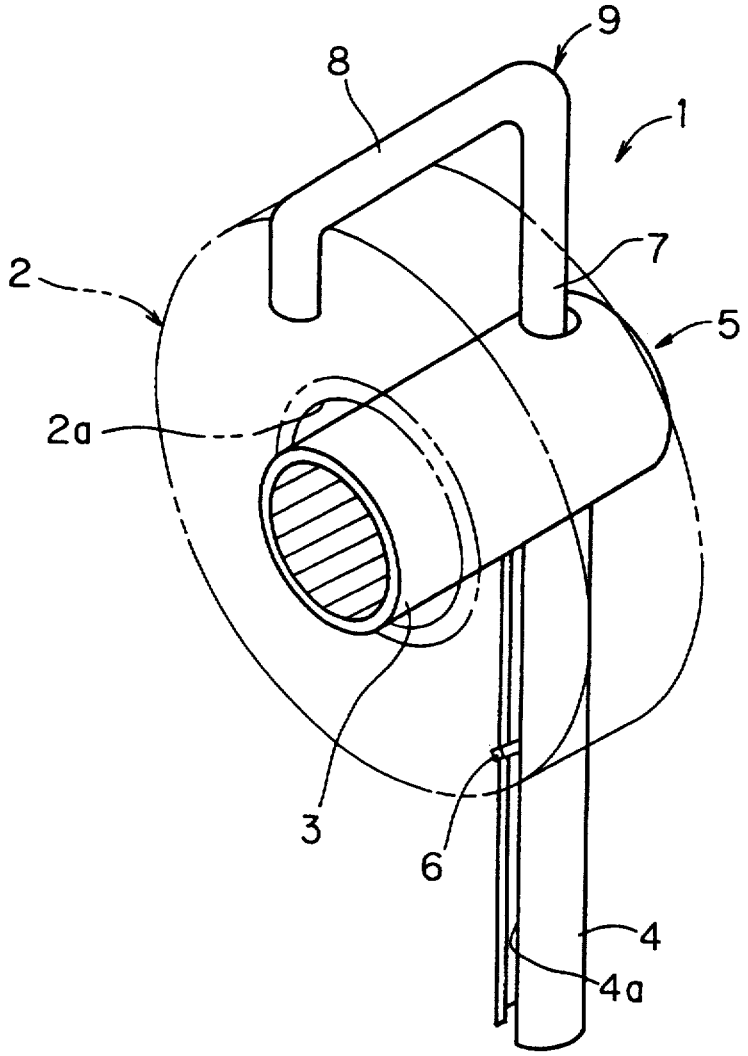
FIG. 5 PRIOR ART
FIG. 5 is a perspective view of the prior art.
Figure 6:
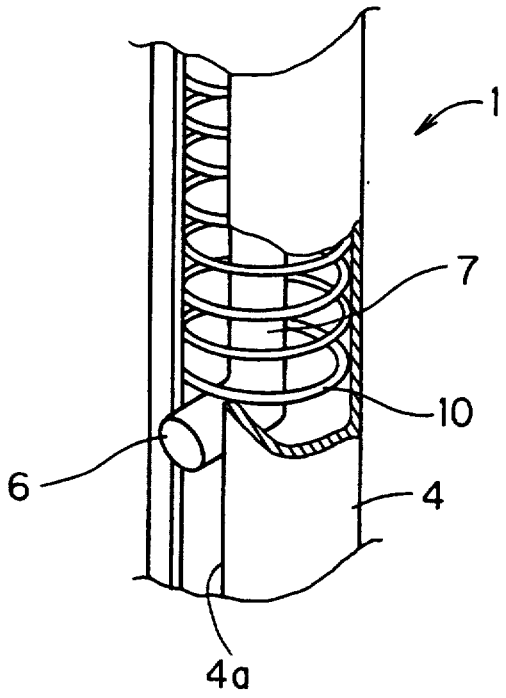
FIG. 6 PRIOR ART
FIG. 6 is a fragmentary perspective view on an enlarged scale of the prior art.

The axis N of the support shaft portion 32 and an axis T of the tape hold-down portion 34 are in slightly skew relation to each other as shown in FIG. 4, and the axis T of the tape hold-down portion 34 is inclined at a slight angle $\theta$ with respect to the axis M of the drum body 21. A locking groove 35 of a slot configuration is formed at the other end of the support shaft portion 32.

The coil spring 23 is housed in the spring-receiving recess 27 and includes a first end lock portion 23*a* locked by the slot 26 and a second end lock portion 23*b* locked by the locking groove 35. The tape restraining member 22 is elastically urged by the urging force of the coil spring 23 so as to be rotated about the axis N of the support shaft portion 32. The connecting portion 33 abuts against the rotation-preventing projection 30 movably toward and away from the rotation-preventing projection 30.

To prevent the second end lock portion 23*b* from being released from the locking groove 35, the second end lock portion 23*b* is locked by the locking groove 35 and is then compressedly deformed such that an opening end of the locking groove 35 is narrowed.

For holding the vinyl tape 24, the front end of the drum body 21 of the non-adhesive tape holder 20 is put on one side of the central hole 25*a* of the vinyl tape 24 in such a manner that a finger is inserted in the finger-receiving recess 29 of the drum body 21 to fixedly hold the drum body 21 between the finger inserted in the finger-receiving recess 29 and another finger put on the outer periphery of the vinyl tape 24. The tape restraining member 22 is then rotated about the axis N of the support shaft portion 32 against the urging force of the coil spring 23. As illustrated in phantom lines in FIG. 3, the drum body 21 is completely inserted into the central hole 25*a* of the vinyl tape 24, with the tape hold-down portion 34 widely spaced apart from the outer peripheral surface 21*b* of the drum body 21. When the tape restraining member 22 is released, the urging force stored in the coil spring 23 returns the tape restraining member 22 in the reverse direction about the axis N of the support shaft portion 32. The space between the tape hold-down portion 34 and the outer peripheral surface 21*b* of the drum body 21 becomes shorter, resulting in the vinyl tape 24 pressed from outside by the tape hold-down portion 34. The vinyl tape 24 is satisfactorily held by the holder 20 without coming unwound.

It should be noted that the vinyl tape 24 is fitted on the drum body 21 in such a manner that a free end of the tape hold-down portion 34 is inclined in an extracting direction of the vinyl tape 24 with respect to the axis of the fitted vinyl tape 24 as shown in FIG. 4.

The preferred embodiment of the present invention is constructed as above described. The vinyl tape 24, if non-adhesive, is pressed by the tape hold-down portion 34 at all times, and is prevented from coming unwound carelessly during storage and operation. There is no need to always grip the vinyl tape 24 during tape winding, but the vinyl tape 24 may be wound in such a manner as to be tossed out from this side to the other side, which is advantageous in that the vinyl tape 24 is tightly wound.

Furthermore, the support shaft portion 32 of the tape restraining member 22 of generally inclined U shape is supported by the drum body 21 rotatably about the axis N parallel to the axis M of the drum body 21 in the position eccentric relative to the axis M of the drum body 21. The rotation of the support shaft portion 32 about the axis N allows the tape hold-down portion 34 to move toward and away from the outer peripheral surface 21*b* of the drum body 21. The non-adhesive tape holder 20 does not project so much from the outer peripheral surface of the vinyl tape 24 as shown in FIGS. 1 and 4. The tape hold-down portion 34 is designed to gradually approach the outer peripheral surface 21*b* of the drum body 21 as the outer diameter of the vinyl tape 24 is gradually smaller while the vinyl tape 24 is used. Thus, the non-adhesive tape holder 20 does not project so much from the outer peripheral surface of the vinyl tape 24 at all times. This effectively prevents the non-adhesive tape holder 20 from contacting or hitching on other jigs or products during tape winding, thereby remarkably increasing the operating efficiency during tape winding. The use of the non-adhesive vinyl tape 24 eliminates the likelihood of dust applied thereto.

Since the free end of the tape hold-down portion 34 is inclined in the extracting direction of the vinyl tape 24 with respect to the axis of the vinyl tape 24 as shown in FIG. 4, a force in the direction of the arrow P acts on the non-adhesive tape holder 20 through the tape restraining member 22 when the vinyl tape 24 is extracted. This permits the holder 20 to be stably fitted to the vinyl tape 24, effectively preventing the holder 20 from being released from the vinyl tape 24 during tape winding.

The pressing force of the tape hold-down portion 34 toward the vinyl tape 24 may be suitably determined by changing the spring force of the coil spring 23.

While the invention has been shown and described in detail, the foregoing description is in all aspects illustrative and not restrictive. It is therefore understood that numerous modifications and variations can be devised without departing from the scope of the invention.

What is claimed is:

1. A non-adhesive tape holder for holding a non-adhesive wound tape, comprising:

a drum body having a recess and received in a central hole of said wound tape, a tape restraining member rotatably supported by said drum body, an urging element for elastically urging said tape restraining member so as to rotate said tape restraining member, and a rotation-preventing projection for regulating the rotation of said tape-restraining member, said tape restraining member being of a generally inclined U shape and including a support shaft portion supported by said drum body rotatably about an axis parallel to the axis of said drum body in a position eccentric relative to the axis of said drum body, a connecting portion extending perpendicularly to the axis of said support shaft portion from one end of said support shaft portion, and a tape hold-down portion extending perpendicularly to the axis of said connecting portion from an extending end of said connecting portion, said urging element being housed in said recess of said drum body for engaging said support shaft portion to elastically urge said tape restraining member for rotation of said tape restraining member about the axis of said support shaft portion, said rotation-preventing projection being provided on one end surface of said drum body so that said connecting portion of said tape restraining member rotated by the urging force of said urging element abuts against said rotation-preventing projection movably toward and away from said rotation-preventing projection.

2. The non-adhesive tape holder of claim 1, wherein said drum body further includes a generally cylindrical outer peripheral portion and a finger-receiving recess formed by partially notching said outer peripheral portion from one side surface.

3. The non-adhesive tape holder of claim 1, wherein said drum body further includes a slot extending in its axial direction, said support shaft portion includes a locking groove at one end, said urging element is a coil spring, and said coil spring has a first end locked by said slot of said drum body and a second end locked by said locking groove of said support shaft portion.

4. The non-adhesive tape holder of claim 3, wherein said locking groove is formed in a slot configuration at an end of said support shaft portion, and said locking groove at its opening end is compressedly deformed to be narrowed to prevent the second end of said locked coil spring from being released therefrom.

5. The non-adhesive tape holder of claim 1, wherein said tape hold-down portion has an axis inclined at a slight angle with respect to the axis of said drum body.

* * * * *